United States Patent [19]

Unruh

[11] 4,171,775

[45] Oct. 23, 1979

[54] RETRACTING AGRICULTURAL IRRIGATION SPRINKLER

[76] Inventor: Paul Unruh, P.O. Box 70, Minden, Nev. 89423

[21] Appl. No.: 877,266

[22] Filed: Feb. 13, 1978

[51] Int. Cl.[2] ..... B05B 3/04; B05B 15/10

[52] U.S. Cl. ..... 239/206; 239/271

[58] Field of Search ..... 239/203, 204, 205, 206, 239/210, 240, 271

[56] References Cited

U.S. PATENT DOCUMENTS

| | | | |
|---|---|---|---|
| 1,484,888 | 2/1924 | Johnson | 239/204 |
| 1,999,470 | 4/1935 | Munz | 239/204 X |
| 3,033,467 | 5/1962 | Hofer | 239/204 |
| 3,637,139 | 1/1972 | Felix | 239/206 |
| 3,655,132 | 4/1972 | Rosic | 239/206 |
| 3,733,030 | 5/1973 | Carstenson | 239/205 |
| 3,752,403 | 8/1973 | Diest | 239/204 |
| 3,921,910 | 11/1975 | Hayes et al. | 239/205 |

FOREIGN PATENT DOCUMENTS

| | | | |
|---|---|---|---|
| 1256534 | 12/1971 | United Kingdom | 239/205 |

*Primary Examiner*—Johnny D. Cherry
*Attorney, Agent, or Firm*—Victor Sepulveda

[57] ABSTRACT

Upright cylinder buried underground has riser which is thrust upward to a raised position where the top is above ground. Motor in the top of the riser carries and rotates a sprinkler nozzle. Piston retracts riser, and during retraction, water flow washes the riser as it is drawn into the cylinder. An internal check valve prevents ground water from entering the system.

7 Claims, 5 Drawing Figures

RETRACTING AGRICULTURAL IRRIGATION SPRINKLER

BACKGROUND

This invention is directed to a retracting agricultural irrigation sprinkler which can be withdrawn into the ground for tillage of the field and, on demand, its riser is thrust upward through the soil so that a motor in the top of the riser rotates the sprinkler nozzle mounted thereon for overhead irrigation sprinkling. When desired, the riser can be retracted for further tillage.

Many of the agricultural areas of the world have insufficient rainfall for directly satisfying the moisture needs of crops. Therefore, irrigation has been extensively used to aid in crop production in otherwise unsuitable areas. Historically, the water has been supplied by flooding channels adjacent the crop being irrigated. However, many crops can be more satisfactorily irrigated by overhead sprinkling. The advent of high-pressure pumps has produced water supplies which can be discharged through sprinkler heads to produce the overhead sprinkling. In addition to the simulation of rainfall conditions, the use of overhead sprinkling often conserves on the total water requirement.

All fields must be tilled for maximum crop production. As a consequence of this tillage requirement, portable sprinkler lines have been developed for placement on the surface after tillage is complete. These temporary sprinkler lines are satisfactory and the desired result is achieved, but require a considerable amount of manpower for the placement and removal of such lines. In order to save this manpower, devices for permanent underground burial have been developed. Carstenson U.S. Pat. No. 3,733,030 is an example of a device intended for such utilization. However, a number of problems in its configuration severely limit its widespread utilization.

SUMMARY

In order to aid in the understanding of this invention, it can be stated in essentially summary form that it is directed to a retracting agricultural irrigation sprinkler which has a cylinder for below-ground installation and a riser secured to a piston in the cylinder. The top of the riser carries a water motor and a sprinkler nozzle mounted on the water motor for rotation thereby.

It is thus an object of this invention to provide a retracting agricultural irrigation sprinkler which can be buried with its cylinder below ground so that its riser can extend above the ground for sprinkler irrigation of the adjacent ground. It is another object to provide such a retracting agricultural irrigation sprinkler wherein the principal parts which move during irrigation sprinkling, with the rotating sprinkler nozzle and the motor which drives it, are above the ground so that they are accessible for replacement without need for excavation down to the buried retraction cylinder. It is a further object to provide a seal in the upper end of the buried cylinder whereby dirt is prevented from penetrating into the cylinder during sprinkling, and during retraction of the riser, water is discharged at the seal to wash off the riser as it is drawn into the cylinder. It is another object to provide a retracting agricultural irrigation sprinkler which has a check valve therein which prevents the entrance of ground water into the sprinkler system and its supply pipe when the agricultural irrigation sprinkler is not in use.

The features of the present invention which are believed to be novel are set forth with particularity in the appended claims. The present invention, both as to its organization and manner of operation, together with further objects and advantages thereof, may be understood best by reference to the following description taken in conjunction with the accompanying drawings.

DESCRIPTION OF THE PREFERRED EMBODIMENT

Figure 1:
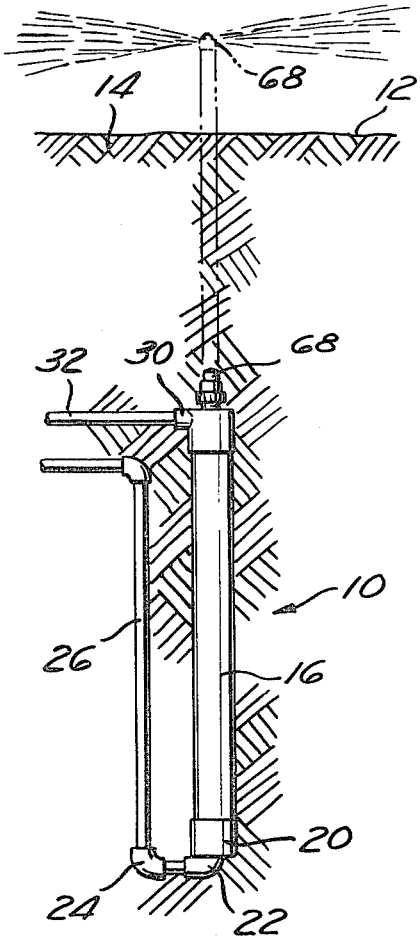
FIG. 1 is a side-elevational view of the retracting agricultural irrigation sprinkler of this invention shown in its buried position with its riser retracted and showing the relative position of the riser in dot-dash lines when the riser is extended.
Figure 4:
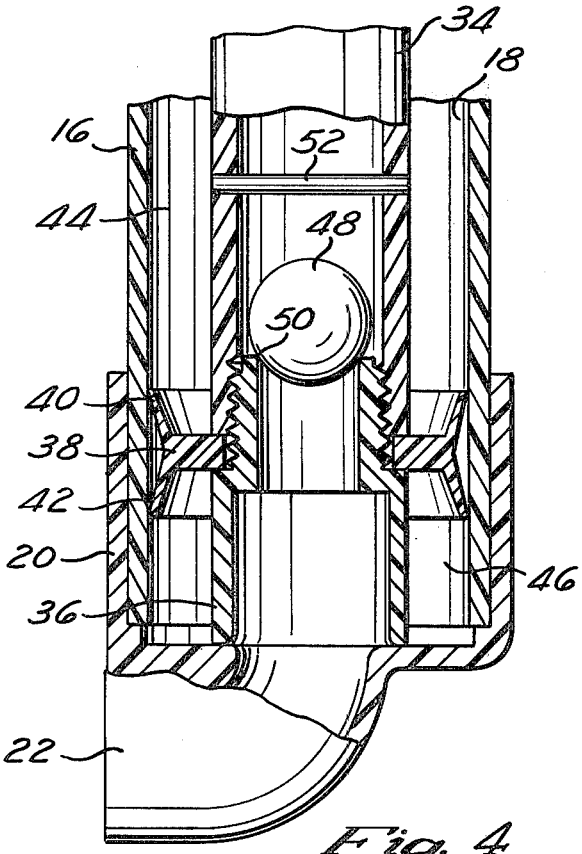
FIG. 4 is an enlarged transverse section through the bottom portion of the irrigation sprinkler, with parts broken away and parts taken in section.

In FIG. 1, the retracting agricultural irrigation sprinkler is shown in its entirety and is generally indicated at 10. It is buried in an upright position below the surface 12 of the soil 14 of an agricultural area, such as a field in which crops are grown. Sprinkler 10 comprises a tubular upright, circular cylinder 16 having a cylindrical interior surface 18. Bottom cap 20, see FIGS. 1 and 4, is attached to the bottom of cylinder 16 and connects the interior volume 46 thereof by means of elbow connections 22 and 24 to supply pipe 26.

Top cap 28 is engaged on the top which encloses the top of cylinder 16. By means of connector 30, it permits the connection of control pipe 32 to the upper volume 44 of the interior of cylinder 16.

Figure 2:
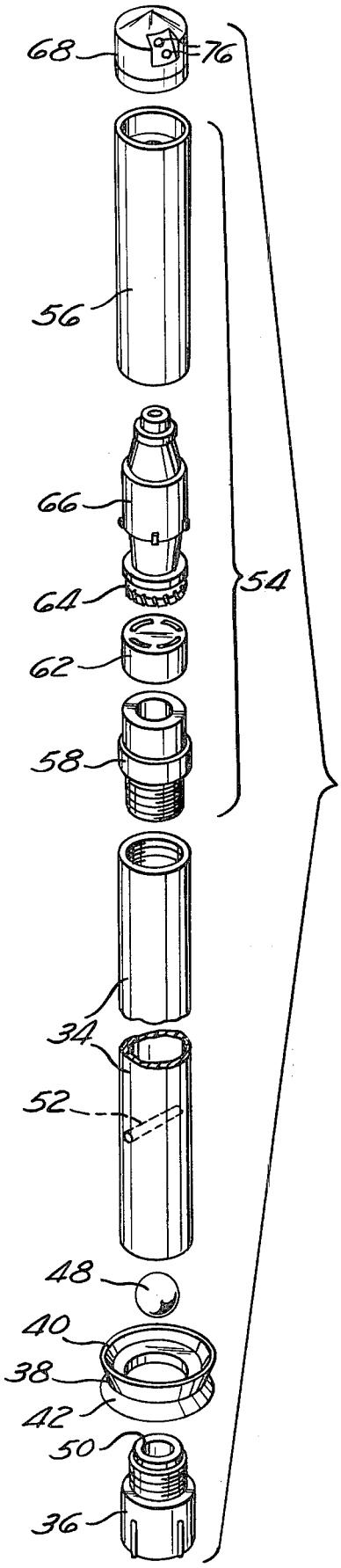
FIG. 2 is an exploded isometric view of the retracting riser structure of the irrigation sprinkler of this invention.

Piston rod 34 is positioned within cylinder 16 and serves as the lower portion of the riser of the retracting irrigation sprinkler of this invention. The entire riser is seen in FIG. 2 where nut 36 engages in screwthreads in the lower end of the piston rod portion of the riser. Piston 38 is clamped to the bottom of the piston rod 34 by means of this nut. Piston 38 has flanges 40 and 42 which act as seal lips which engage on the interior surface 18 of the cylinder 16 to minimize leakage therepast. Thus, piston 38 divides the cylinder into an upper volume 44 and lower volume 46, see FIG. 4.

The piston rod 34 is a hollow, circularly cylindrical tube. Ball valve 48 is positioned in the interior thereof at its lower end and finds its seat 50 at the upper, interior corner of the passage through nut 36. Stop 52, which is a rod across the interior tubular opening of piston rod 34, acts as a stop to prevent ball valve 48 from rising too far. Ball valve 48 inhibits downward flow through the riser, but permits upward flow therethrough.

Motor assembly 54 serves as the upper part of the riser and is detachably mounted on the top of the piston rod 34 thereof. Motor assembly 54 comprises tubular motor housing 56 which is secured to connector 58. Connector 58 is screwed into the top of piston rod 34, and motor housing 56 and connector 58 have the same diameter as the exterior piston rod 34 so that all three present a smooth, continuous, uniform, cylindrical exterior riser surface. However, by virtue of the screwthread 60, the motor assembly can be readily detached from the top of the piston rod. Interiorly of motor housing 56, motor nozzle 62, motor rotor 64, and geared speed reducer 66 are mounted.

Figure 3:
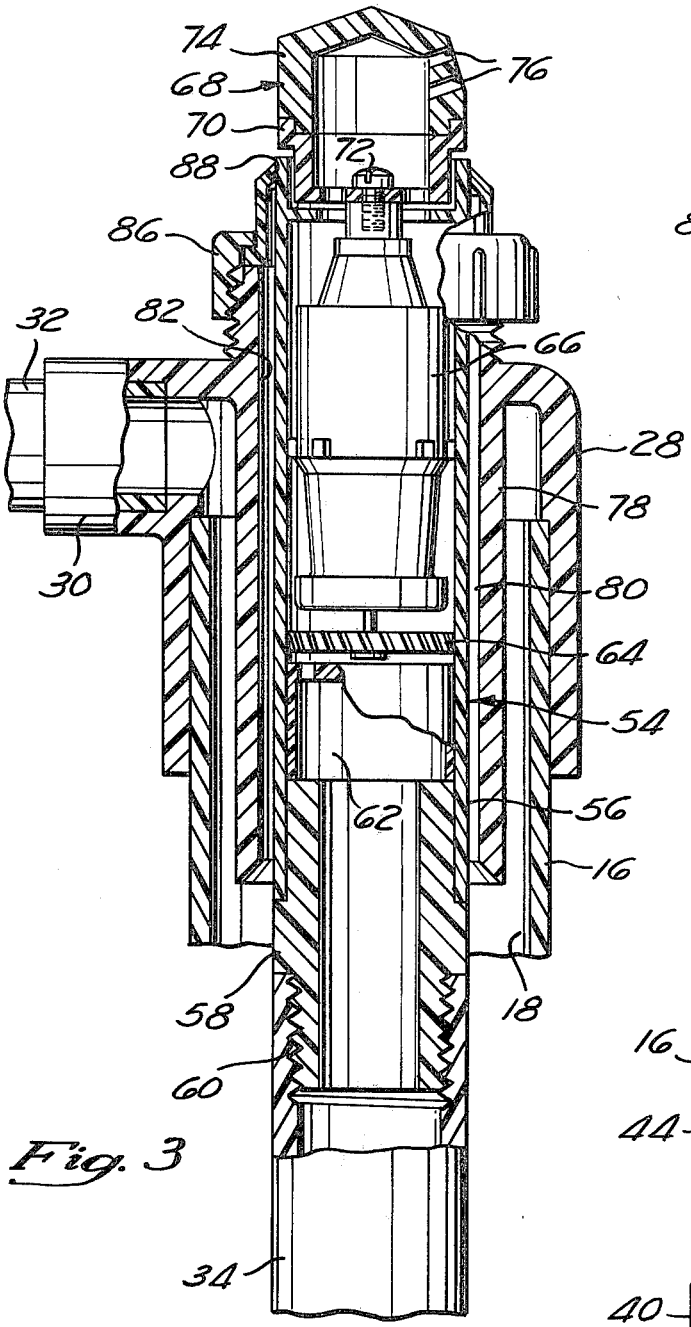
FIG. 3 is an enlarged transverse section through the top portion of the irrigation sprinkler, with parts broken away and parts taken in section.
Figure 5:
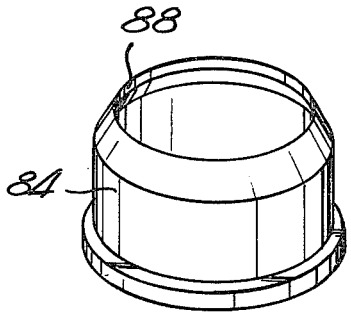
FIG. 5 is an isometric view of the seal positioned around the riser at the top of the cylinder.

Secured to the top of the motor assembly is sprinkler nozzle 68. As seen in FIGS. 2 and 3, it comprises base 70 which is secured to the slow speed output shaft on the top of gear reducer 66 by means of screw 72. Cap 74 is mounted on base 70 and has sprinkler nozzle openings 76 therein. There may be several such openings to obtain the desired sprinkler pattern. The outside diameter of sprinkler nozzle 68 is the same as the outside of motor housing 56, but the clearances around the lower portion of the sprinkler nozzle are such that there are no rubbing points between the sprinkler nozzle and the upper part of motor assembly 54. In this way, the sprinkler nozzle can turn on the top of the motor assembly without frictional wear.

Sleeve 78, see FIG. 3, is integrally formed in top cap 28 and extends downward from the top thereof around the exterior of the riser to define a narrow annular space 80 around the upper part of the riser. The riser extends up out of the top of top cap 28 through riser opening 82. The top of the riser opening is closed by resilient seal ring 84 which is held in place by ring nut 86. The upper edge of seal ring 84 is a lip 88 which seals against the exterior surface of the riser.

The lengths of the cylinder and piston rod-riser are such that, when the riser is in the fully retracted position shown in FIGS. 3 and 4 with nut 36 against bottom cap 20, seal 84 engages against the upper part of the riser just below sprinkler nozzle 68, as seen in FIG. 3.

Furthermore, the lengths of the various parts are such that, with the riser retracted and with the sprinkler 10 buried at an appropriate distance below ground level (for example, such that sprinkler nozzle 68 is 18 inches below the surface 12 of the soil), then a sufficient amount of soil is presented above the retracted irrigation sprinkler that normal soil tillage can take place.

A preferred material for most of the parts is substantially rigid polyvinyl chloride, a thermoplastic synthetic polymer composition material which is adhesively bondable. The seal and piston are preferably made at a composition so that they are more rubber-like. When sprinkling is desired, pressure is supplied to supply pipe 26, and control pipe 32 is opened to drain. Now, pressure is supplied below piston 38 thrusting the piston and riser upward. In addition to supplying pressure to the bottom of the piston, pressurized water is also supplied upward through the interior of the riser, through the motor assembly 54 which turns the sprinkler nozzle 68, and through openings in the top of the motor assembly and the bottom of the sprinkler nozzle supplies sprinkler water out of nozzle openings 76. The nozzle rises rotating and bores a hole upward through the soil until the structure is in its topmost position where the piston 38 engages under sleeve 78. As long as sprinkling is desired, pressure water is delivered to supply pipe 26, and the sprinkler nozzle rotates and delivers water. The structure is sufficiently high above the ground that, should a failure occur in the moving structure (that is, in the motor assembly), the motor assembly 54 can be unscrewed with the top of piston rod 34 still extending above the ground. Thus, maintenance can be readily managed without excavation. A new motor assembly is installed in place. The sprinkler can remain extended above the ground level, even without water supply, until it is again desired that tillage take place.

Upon a desire to till the fields, supply pipe 26 is connected to drain, and control pipe 32 is pressurized. This supplies water under pressure to the top of the piston, and the riser is retracted. As the riser is retracted, water flows upward through the narrow annular space 80 and leaks out through seal 84 between its lip 88 and the exterior surface of the riser. This washes the riser as it is retracted so that no dirt is drawn down into the cylinder. When fully retracted, then control pipe 32 is again connected to drain. During this quiescent, retracted condition of the agricultural irrigation sprinkler, ball valve 48 prevents downflow of ground water into nozzle 68, thus keeping dirt out of the structure. In this way, a retracting agricultural irrigation sprinkler is achieved where maintenance is minimized by preventing entry of dirt during retraction by washing the riser and by design which minimizes the rotating parts and eliminates rotating part seals. Maintenance of the small portion that rotates is easily achieved by the removability and replaceability of the motor assembly when the sprinkler structure is extended, without the need for excavation. Thus, a superior sprinkler is attained.

This invention having been described in its preferred embodiment, it is clear that it is susceptible to numerous modifications and embodiments within the ability of those skilled in the art and without the exercise of the inventive faculty. Accordingly the scope of this invention is defined by the scope of the following claims:

What is claimed is:

1. A rotating agricultural irrigation sprinkler system comprising:

a cylinder for substantially upright subterranean installation at a position substantially deep to permit tillage over the installed cylinder;

a piston in said cylinder and being adapted to move in said cylinder and for separating said cylinder into an upper chamber and a lower chamber;

a riser positionable in said cylinder connected to said piston to move with said piston and extendable above said cylinder and subterranean position, said riser being formed of a piston rod and a motor assembly mounted on the end of said piston rod away from said piston and being extendable above said subterranean position;

a resilient cylindrical hollow seal on the upper-most position on said cylinder and around said riser where said riser extends from said cylinder and includes a cylindrical lip portion adapted to firmly press against said riser;

water motor means in said motor assembly and being adapted to rotate when water pressure is applied thereto;

a sprinkler nozzle coupled to rotate by said water motor means and be extended above said subterranean position by said riser and below said subterranean position by said riser and positionable within said seal when below said subterranean position and not in use; and connection means on said cylinder to selectively supply water under pressure to the chamber above and the chamber below said piston to respectively retract said riser so that it is substantially entirely within said cylinder and to a position wherein said sprinkler nozzle is within said seal and extend said riser to a position wherein said motor assembly and said sprinkler nozzle are extended sufficiently far from said cylinder to extend above the ground to effect irrigation thereof.

2. The irrigation sprinkler as defined in claim 1 wherein, said chamber above said piston in said cylinder being connected to said seal around said riser so that when water under pressure is supplied to said chamber in said cylinder above said piston, water under pressure is supplied to said seal and passes thereby to wash off said riser as said riser is retracted.

3. The irrigation sprinkler of claim 2 wherein said seal is a lip seal having an extended lip engaging said riser above said cylinder and a ring nut engaged on said cylinder and clamping said lip seal to said cylinder so that the lip on said lip seal is away from said cylinder to permit expansion of said lip when water under pressure is supplied to the interior thereof to permit leakage past said riser to wash off said riser as said riser is retracted.

4. The irrigation sprinkler of claim 3 wherein said motor assembly is detachably mounted on the top of said piston rod so that said motor assembly can be detached and replaced on said piston rod when said riser is extended from said cylinder.

5. The irrigation sprinkler as defined in claim 2 wherein said riser retracts into said cylinder sufficiently far so that substantially all of said riser is retracted into said cylinder and said sprinkler nozzle extends above said cylinder, but into said seal.

6. The irrigation sprinkler of claim 1 wherein said cylinder and said piston rod, and the parts of the irrigation sprinkler attached thereto are made of an adhesively bondable synthetic polymer composition matter.

7. The irrigation sprinkler of claim 6 wherein said piston rod and cylinder are cut from elongated stock material at a selected length to provide for sufficient riser stroke to permit the cylinder to be installed adequately deep in the ground for tillage thereover when the riser is retracted and for the riser to extend sufficiently high above the ground for irrigation sprinkling purposes when the riser is extended, and said cylinder is adhesively bonded to top and bottom cylinder caps to close said cylinder and define the length of said cylinder.

* * * * *